United States Patent [19]

Jennings

[11] 4,439,487

[45] Mar. 27, 1984

[54] POLYESTER/NYLON BICOMPONENT FLAMENT

[75] Inventor: Uel D. Jennings, Signal Mountain, Tenn.

[73] Assignee: E. I. Du Pont de Nemours & Company, Wilmington, Del.

[21] Appl. No.: 450,778

[22] Filed: Dec. 17, 1982

[51] Int. Cl.[3] ..... D02G 3/00

[52] U.S. Cl. ..... 428/397; 57/250; 57/253; 57/908; 428/370; 428/372; 428/374

[58] Field of Search ..... 428/397, 370, 373, 374, 428/372, 375, 395, 369; 264/171, 177 F; 57/243, 250, 253, 908

[56] References Cited

U.S. PATENT DOCUMENTS

| | | | |
|---|---|---|---|
| 3,092,892 | 6/1963 | Ryan et al. . | |
| 3,156,607 | 11/1964 | Strachan | 264/177 F |
| 3,315,021 | 4/1967 | Luzzatto | 264/177 F |
| 3,316,612 | 5/1967 | Stump | 428/369 X |
| 3,458,390 | 7/1969 | Ando et al. | 428/373 |
| 3,489,641 | 1/1970 | Harcolinski . | |
| 3,551,279 | 12/1970 | Ando et al. | 428/397 X |
| 3,607,611 | 9/1971 | Matsui et al. . | |
| 3,718,534 | 2/1973 | Bkamoto et al. | 428/397 X |
| 3,781,399 | 12/1973 | Kobayashi et al. | 264/171 |
| 4,118,534 | 10/1978 | Stanley | 428/370 |

*Primary Examiner*—Lorraine T. Kendell

[57] ABSTRACT

Nylon/polyester bicomponent filaments of dumbbell cross-sectional shape having a jagged interfacial surface, the polyester being an antimony-free copolyester having 5-(sodium sulfo) isophthalate units. The surface of the bicomponent filament being at least 75% of one of the polymeric components.

6 Claims, 6 Drawing Figures

POLYESTER/NYLON BICOMPONENT FLAMENT

BACKGROUND OF THE INVENTION

This invention relates to a polyester/nylon bicomponent filament that does not come apart along the interfacial junction of the polymers during normal fiber processing or during normal fabric manufacturing processes. This invention also relates to a bicomponent filament that when heated in the form of yarn under low or no tension will shrink and crimp without splitting along the interfacial junction line of the polymers, resulting in a yarn having high bulk, good cover, and spun-like tactile aesthetics.

Bicomponent textile filaments of polyester and nylon are known in the art, and are described in Harcolinski et al., U.S. Pat. No. 3,489,641. According to the aforesaid patent, a yarn that crimps but does not split on heating is obtained by using a particular polyester. The invention of this application is another bicomponent filament having these desirable properties.

It is also known to employ as the polyester component of the bicomponent filament a polyester which is free from antimony, it having been determined that antimony in the polyester reacts with nylon to form a deposit in the spinneret which produces a shorter junction line, and thus a weaker junction line. Such products are claimed in U.S. patent application Ser. No. 168,152, filed July 14, 1980. The present invention uses antimony-free polyester taught to be beneficial by the aforesaid case.

It is also known to make bicomponent filaments using poly[ethylene terephthalate/5-(sodium sulfo) isophthalate] copolyester as the polyester component. Stanley U.S. Pat. No. 4,118,534 teaches such bicomponents. In the bicomponent filament of the present invention the polyester is such a copolyester.

It is also known to make bicomponent filaments in which the one component partially encapsulates the other component. Matsui et al. U.S. Pat. No. 3,607,611 teaches such a bicomponent filament. In the bicomponent filament of the present invention one of the polymeric components is partially encapsulated by the other polymeric component.

It is also known to produce bicomponent filaments in which the interfacial junction between the two polymeric components is at least in part jagged. Kobayashi et al. U.S. Pat. No. 3,781,399 teaches such a bicomponent filament. In the bicomponent filaments of the present invention the interfacial junction between the two polymeric components is at least in part jagged.

Finally, bicomponent filaments having a cross sectional dumbbell shape are known in the art. Ryan et al. U.S. Pat. No. 3,092,892 teaches such bicomponent filaments. The bicomponent filaments of the present invention have a dumbbell cross sectional shape.

DETAILED DESCRIPTION

The present invention is a bicomponent filament in which one component is antimony-free polyethylene terephthalate modified with 0.5 to 0.3 mole percent 5-(sodium sulfo) isophthalate units, and the other component is polyhexamethylene adipamide. The interfacial junction between the two polymeric components of the bicomponent filament is at least in part jagged. The bicomponent filament is readily crimpable and dyeable and has a high resistance to longitudinal splitting.

The bicomponent filament may be made up of polymers that have widely different melt viscosities at the spinning temperature. Either or both polymeric components of the bicomponent filament may contain the usual antioxidants, antistatic agents, brightener, pigments and the like traditionally employed in the art.

The preferred filaments of this invention when drawn have a denier in the range of about 1 to 5, and the dumbbell cross-sectional shape is such that the width of the neck (the narrowest part of the dumbbell located approximately midway between the heads of the dumbbell) is about 30 to 60 percent of the diameter of the head of the dumbbell. In the preferred filaments of this invention the interfacial junction between the two polymeric components is at least 15% jagged—this amount is determined by microscopically photographing and then measuring the entire length of the interfacial junction, and then calculating the percent that is jagged.

EXAMPLE

Figure 1:
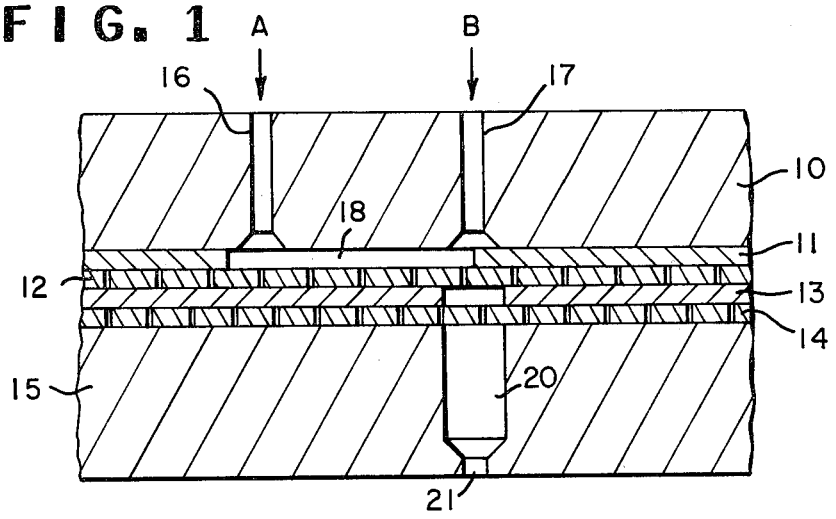
FIG. 1 is a sectional view of a spinning assembly for spinning the new bicomponent filaments, the arrows indicating the directions of polymer flow. Polymers A and B are separately fed in the molten state to the spinning assembly comprising the usual filtration media and associated hardware. The separate polymer streams pass through rounded bores 16 and 17 of meter plate 10 and into channel 18 of upper shim 11 where they meet and flow side-by-side downwardly through shim 12 having small round holes, shim 13 having large round holes, shim 14 having slot holes, and a capillary having a counterbore 20 of spinneret plate 15. Counterbore 20 of the capillary has an outlet aperture 21. The slot holed shim 14 is arranged so that the long axis of the slots lay parallel to the long axis of the outlet aperture 21. The filament exits from the capillary into a chimney (not shown) where it is quenched. The filament is then coated with finish, drawn and wound up in conventional fashion.
Figure 2:
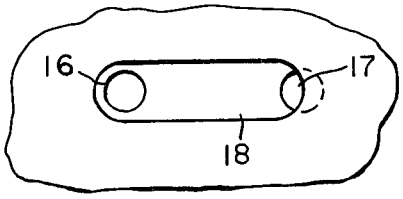
FIG. 2 is a bottom sectional view of upper shim 11 showing the alignment of chamfered orifices of bores 16 and 17 and channel 18.
Figure 3:
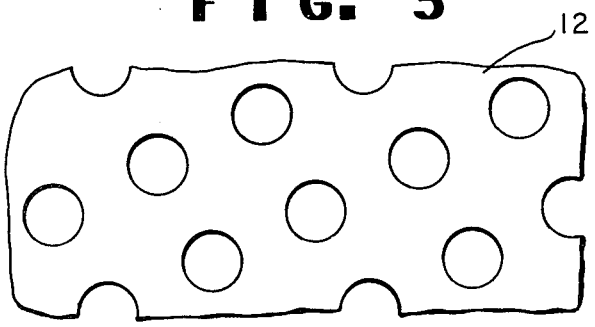
FIG. 3 is a top sectional view (greatly enlarged) of a portion of shim 12.
Figure 4:
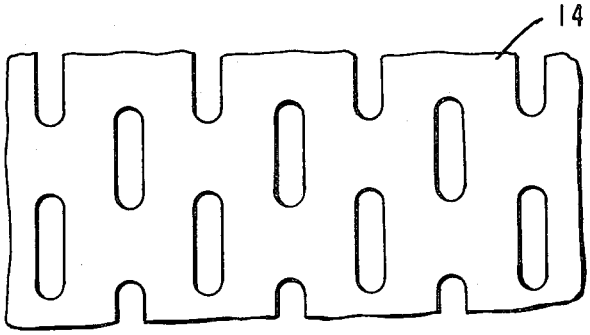
FIG. 4 is a top sectional view (greatly enlarged) of a portion of shim 14.
Figure 5:
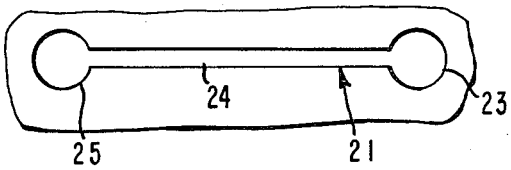
FIG. 5 is a bottom view of the spinneret aperture 21.

A 35 denier yarn of bicomponent filaments may be produced by melt spinning at 310° C. polyhexamethylene adipamide having a relative viscosity, RV, of about 55, and antimony-free polyester of poly[ethylene terephthalate/5-(sodium sulfo) isophthalate] containing about one mole percent of the isophthalate component, side-by-side. The polyester should have a relative viscosity, RV, of about 17. The polyhexamethylene adipamide component will pass through bore 16, and the polyethylene terephthalate component will pass through bore 17 of a spinneret assembly as shown in FIG. 1. Both polymers may contain 0.3% $TiO_2$. Spinneret assembly dimensions may be as follows:

| | |
|---|---|
| Meter plate 10 thickness | 0.185" |

-continued

| | |
|---|---|
| Shim 11 thickness | 0.005" |
| Shim 11 channel width | 0.080" |
| Shim 11 channel length | .241" |
| Shim 12 thickness | 0.005" |
| Shim 12 hole diameter | 0.006" |
| Shim 12 hole frequency | 10,000/in$^2$ |
| Shim 13 thickness | 0.003" |
| Shim 13 hole diameter | 0.070" |
| Shim 14 thickness | 0.003" |
| Shim 14 slotted hole length | 0.012" |
| Shim 14 slotted hole width | 0.003" |
| Shim 14 slotted hole frequency | ~10,000/in$^2$ |
| Spinneret plate 15 thickness | 0.315" |
| Spinneret capillary dimensions: | |
| Diameter of counterbore 20 | 0.078" |
| Aperture 21 dimensions:" | |
| Slot 24 width | 0.003" |
| Circles 23 and 25 diameter | 0.009" |
| Distance center to center from circle 23 to 25 | 0.051" |

The freshly-spun filaments may be quenched by cross-flow cooling air and converged to a yarn. Aqueous spin finish may be applied and the yarn may be drawn 2× by passing between a feed roller and a draw roller operating at 3500 ypm surface speed. The draw point may be localized by a steam draw jet positioned between the rollers supplying steam at a pressure of 60 psig. The yarn may be then passed over a set of rolls in a closed chamber heated to 120° C. The yarn filaments may be interlaced by jets of air and aqueous spin finish again applied. The 35 denier/16-filament yarn may be wound to a package at ~3500 ypm. The yarn tenacity and break elongation would be 2.4 grams/denier and 35% respectively. The yarn shrinkage in boiling water under a 5 mg/denier load would be 7%.

Figure 6:
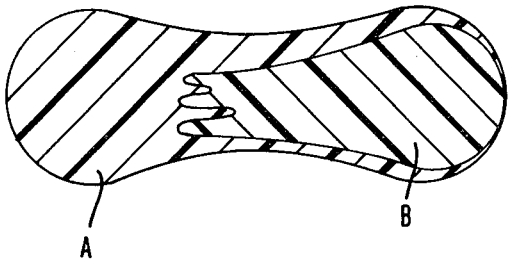
FIG. 6 is a cross-sectional view of the new filament after drawing showing a jagged interfacial junction between the two polymer components A and B.

FIG. 6 is a drawing of the transverse cross-section of a representative filament which is dumbbell shaped. Component A is the polyhexamethylene adipamide and component B is the polyester; area ratio A/B being 50:50. The exterior surface of the bicomponent filament is 80% polyhexamethylene adipamide. The interface between the 2 polymers is jagged as shown.

The filaments are readily crimpable, as indicated by the large increase in bulkiness exhibited when a skein of the yarn is boiled off under a load of 5 mg/denier, which approximates the conditions existing during fabric scouring or dyeing. When the yarn is then x-sectioned, none of the filaments are split or exhibit significant separation at the jagged polymer interface.

The relative viscosity, RV, of the polyester as used in the example is the ratio of the viscosity of a 4.75 weight percent solution of the polyester in hexafluoroisopropanol to the viscosity of the hexafluoroisopropanol per se, measured in the same units at 25° C. The relative viscosity RV of nylon is the ratio of the viscosity of a solution of 8.4 percent (by weight) polymer in a solution of 90 percent formic acid and 10 percent water (by weight) at 25° C., to the viscosity of the formic acid/-water solution, per se, measured in the same units at 25° C.

Since the as-produced yarn is almost crimp free, dense bobbins containing large amounts of yarn may be readily wound. The yarn may be processed into fabric with less difficulty then conventional precrimped yarns because there is not a problem of crimp pullout or yarn snagging. After the yarns are processed to form fabrics, the fabrics may be heated under low or no tension to allow the filaments to crimp. This results in a fabric having high bulk, good cover, and a spun-like feel.

The filaments of this invention may be blended with other bicomponent filaments having other cross-sectional shapes, for example trilobal filaments. Such blends would have different yarn processing characteristics, and fabric made from them would have a different feel and appearance than fabrics made from yarns containing only the filaments of this invention.

Because the yarns made from filaments of this invention may be processed into fabrics without texturing the yarns, the filaments are economically attractive. This economic advantage is especially pronounced when fine denier yarns are to be employed, for the cost on a weight basis of texturing a fine denier yarn is considerably higher than the cost on a weight basis of texturing a heavy denier yarn.

If desired, a bicomponent filament in which the exterior surface of the filament is at least 75% but not more than 95% polyester can be prepared by the process shown in the example by merely feeding the polyester component through bore 16, and the polyamide component through bore 17. Such a filament would not dye as readily as the filament having the polyamide as the major constituent of its exterior surface, but such filaments are expected to have improved wash-and-wear properties.

What is claimed:

1. A bicomponent filament having a dumbbell cross-sectional shape, consisting of between 35 and 65% by volume antimony-free polyethylene terephthalate modified with 0.5 to 3 mole percent 5-(sodium sulfo) isophthalate units, and a complementary amount of polyhexamethylene adipamide, the exterior surface of said bicomponent filament being at least 75% but not more than 95% of one of the polymeric components, the interfacial junction between the two polymeric components being at least in part jagged, said bicomponent filament being readily crimpable and dyeable, and having a high resistance to longitudinal splitting.

2. The bicomponent filament of claim 1 in which the exterior surface of the filament is at least 75% but not more than 95% polyhexamethylene adipamide.

3. The filament of claim 2 in which both polymeric components contain about 0.3% titanium dioxide.

4. The filament of claim 2 in which the denier of the filament is in the range of 1 to 5.

5. The filament of claim 2 in which the neck in the dumbbell shaped cross-section is 30 to 60 percent of the diameter of the head of the dumbbell shaped cross-section.

6. The filament of claim 2 in which the interfacial junction between the two polymeric components is at least 15 percent jagged.

* * * * *